United States Patent [19]

Colodner et al.

[11] Patent Number: 4,614,237

[45] Date of Patent: Sep. 30, 1986

[54] COMBINATION EXHAUST GAS FIRE EXTINGUISHER AND BLOWER MACHINE

[76] Inventors: Jesse L. Colodner, 322 Orangeburg Rd., Pearl River, N.Y. 10965; Edwin D. Ebner, 32 John St., New City, N.Y. 10956

[21] Appl. No.: 787,466

[22] Filed: Oct. 15, 1985

[51] Int. Cl.[4] ..... A62C 35/00

[52] U.S. Cl. ..... 169/12; 169/62; 239/129; 239/289

[58] Field of Search ..... 169/12, 62; 239/129, 239/289

[56] References Cited

U.S. PATENT DOCUMENTS 3,607,780 9/1971 Scott ..... 239/129 X

FOREIGN PATENT DOCUMENTS 608772 8/1926 France ..... 169/12

49375 10/1931 Norway ..... 169/12

*Primary Examiner*—Andres Kashnikow

[57] ABSTRACT

The combination machine is used both as a fire extinguisher and an air blower. Primarily, it consists of a back-pack or other type unit having an internal combustion engine powering a blower. It includes one hose coupled to a pivotal exhaust pipe cover and to the air inlet of the blower, and the hose pipes exhaust gas into the blower when such gas is needed to extinguish a fire. A second hose is provided and is coupled to the blower at one end and is secured to a sleeve fastened to an air cooled cone or nozzle which is used to blow air or exhaust gas, whenever needed.

6 Claims, 5 Drawing Figures

FIG. 1
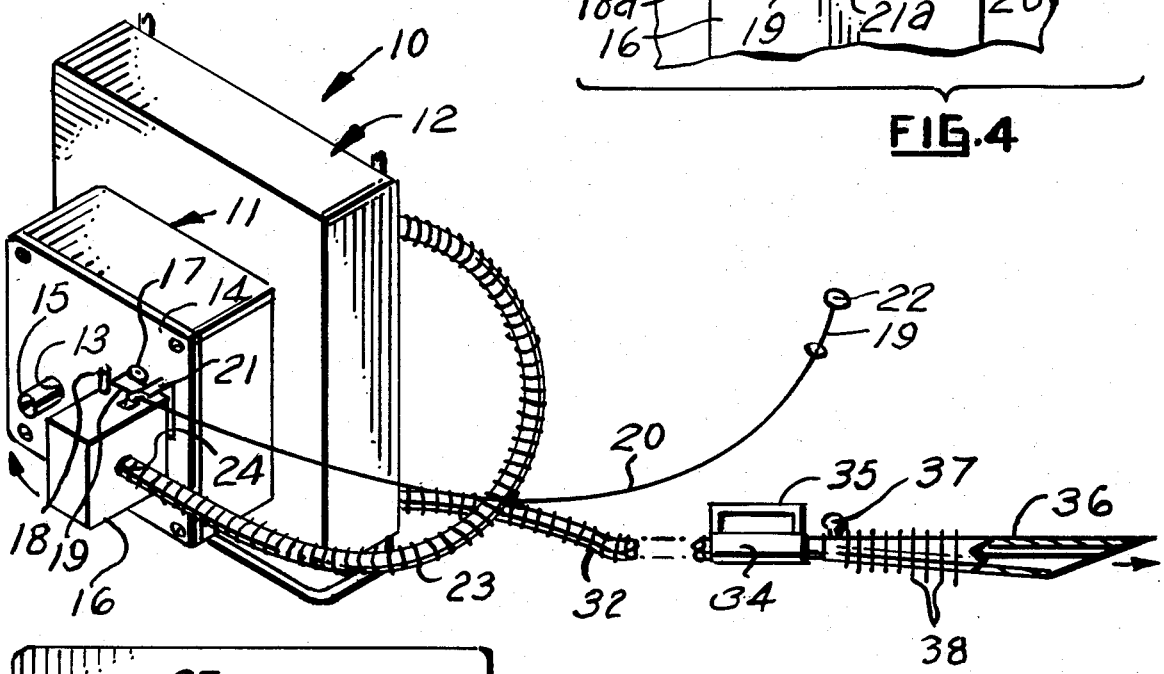
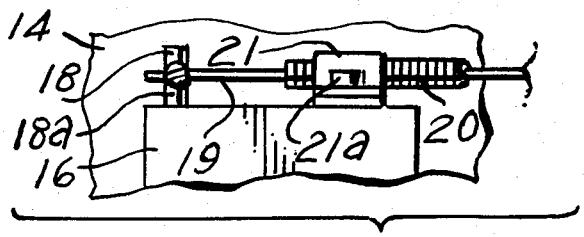
FIG. 4
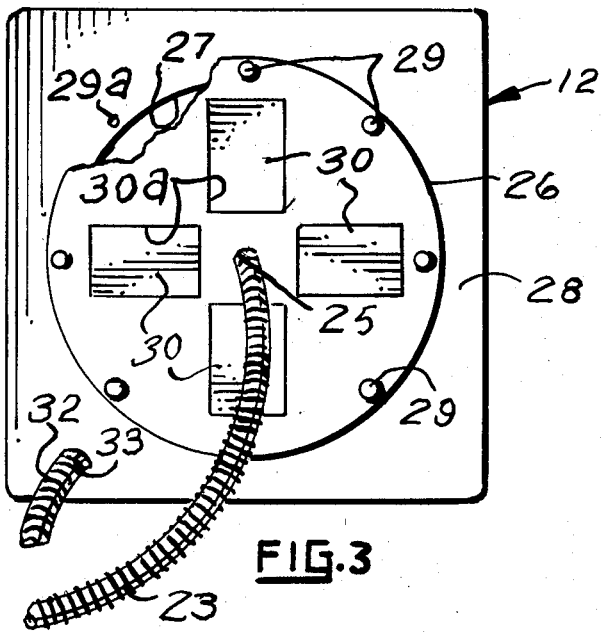
FIG. 3
FIG. 2
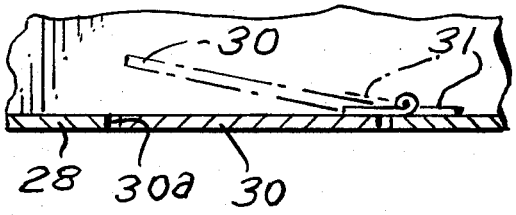
FIG. 5
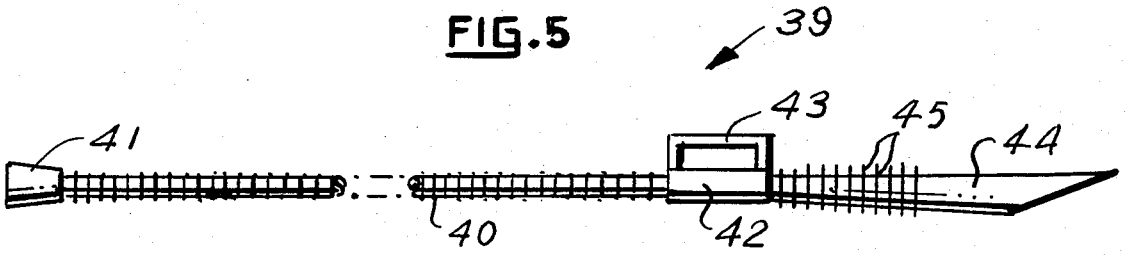

COMBINATION EXHAUST GAS FIRE EXTINGUISHER AND BLOWER MACHINE

BACKGROUND OF THE INVENTION

1. Field of the Invention

This invention relates to both fire extinguishers and blowers, and more particularly, to a combination exhaust gas fire extinguisher and blower machine.

2. Description of Prior Art

A fire extinguisher and a blower machine are known in the art and are of various types. The combination exhaust gas fire extinguisher and blower machine in accordance with the present invention, will employ the exhaust gas of a two-stroke cycle or four-stroke cycle internal combustion engine, as a fire fighting agent, and it will also be used as a blower when desired.

The principal object of this invention is to provide a combination exhaust gas fire extinguisher and blower machine, which will be adaptable as a back-pack or other type unit, and the combination as such will be unique and economical.

Another object of this invention is to provide a combination exhaust gas fire extinguisher and blower machine, which will be further unique, in that the exhaust gas is readily available from machines that employ such engines for many purposes.

Another object of this invention is to provide a combination exhaust gas fire extinguisher and blower machine, which will be of such design, as to include an exhaust outlet hinged cover having a flexible hose which connects with a blower air intake, and the covering and uncovering of the exhaust outlet will be manually controlled by cable means.

A further object of this invention is to provide a combination exhaust gas fire extinguisher and blower machine, which will be of such design, as to include a plurality of spring-loaded louvers in the air intake, which will automatically increase the air intake as engine speed increases, so as to effectively cool the exhaust gas being used to extinguish a fire.

A still further object of this invention is to provide a combination exhaust gas fire extinguisher and blower machine, which will be of such design, as to include an air cooled fire fighting cone or nozzle attached to a second hose, and the fire fighting cone will be used as a blower nozzle at other times.

BRIEF DESCRIPTION OF FIGURES

FIG. 1 is a fragmentary perspective view of the present invention, showing a fire fighting cone or nozzle attached to the blower output hose;

FIG. 2 is a fragmentary top plan view of FIG. 3, showing an open position of one of the louvers in phantom;

FIG. 3 is a fragmentary front view of FIG. 1;

FIG. 4 is an enlarged fragmentary top plan view of the exhaust transfer cover and control thereof;

FIG. 5 is a plan view of a modified form of hose and cone combination.

SUMMARY OF THE INVENTION

A combination exhaust gas fire extinguisher and blower machine, comprising an internal combustion engine within an engine housing secured to a blower housing. The engine housing includes an exhaust gas transfer cover hinged to the engine housing, and the cover is secured to one end of a flexible hose that pipes the exhaust gas into the blower for being forced out of a second hose coupled to an air cooled cone or nozzle that is hand held to direct the gas onto a fire. Atmospheric air is also simultaneously introduced into the blower by spring-loaded louvers in the blower housing for cooling the exhaust gas, and the amount the louvers open depends upon the engine speed. The cover is also controlled by the operator of the machine through flexible cable means.

DETAILED DESCRIPTION

Accordingly, a machine 10 is shown to include an internal combustion engine housing 11 which is suitably secured to a face of a blower housing 12, the engine and the blower not being shown. An opening 13 through the cover plate 14 of housing 11 receives the engine exhaust pipe 15 which normally exhausts the burned fuel into the atmosphere, when machine 10 is functioning as a blower. A box like pivotal cover 16 is hinged at its open end by a hinge 17 secured to cover plate 14, so as to enclose exhaust pipe 13 of the engine for exhaust transfer purposes, which will hereinafter be described. A pin 18 is fixedly secured to the top of cover 16 and the wire 19 of a flexible control cable 20 is fastened therein, by a set screw 18*a*. A bracket 21 holds cable 20 firmly and is secured to the top of cover 16 and cover plate 14 by means of fasteners 21*a*. Wire 20 is pushed and pulled by the control knob 22 by the operator of machine 10, and a first hose 23 is provided and suitably secured in opening 24 in the rear side of cover 16, the opposite end being suitably secured in opening 25 through the center of blower plate 26 which serves to cover the opening 27 through face 28 of blower housing 12. Plate 26 is held to face 28 by screw fasteners 29 received in the openings 29*a*, and when cover 16 is pivoted over exhaust pipe 15, the exhaust gas instead of traveling from the engine into the the atmosphere, travels through hose 23 into the blower in blower housing 12. A plurality of equally and radially spaced louvers 30 are provided and are hinged to the inside surface of the face 28 of blower housing 12 and hinges 31, and louvers 30 are of the spring-loaded type and stay in the closed position in their respective openings 30*a*, when the engine is not running. The engine drive shaft is coupled to the blower and as engine speed is increased by the operator more air is drawn past the louvers 30 because they open more by the differential in pressure caused, and this cooler air traveling through the openings 30*a*, cools the exhaust gas being fed into the blower by hose 23.

A second hose 32 is provided and is suitably secured in opening 33 of the blower housing 12 at one end, and the blower forces the cooled exhaust gas out of hose 32 and into a sleeve 34 which is suitably secured at its opposite end. A handle 35 is fixedly secured to outer periphery of sleeve 34, and the small diameter end of a hollow cone 36 is secured to the opposite end of sleeve 34 by a set screw 37. The end portion of the cone 36 is provided with integrally attached outer cooling fins 38 for more effective cooling.

In operation, the engine is first started, and if machine 10 is needed for fire fighting, the operator uses the control cable 20 which will pivot cover 16 closed, thus causing the exhaust gas of the engine escaping from pipe 15, to travel through hose 23 into the blower of blower housing 12 where it will be forced out of the second hose 32, into cone 36 that is held by the operator through the use of the handle 35. When machine 10 to be used for blowing purposes, the cable 20 is used to pivot cover 16 open, which will prevent exhaust gas from entering the blower, because it will escape into the atmosphere in normal fashion from the engine exhaust pipe 15.

Referring now to FIG. 5, a modified form of device 39 is shown to include a flexible hose 40 of approximately thirty feet in length and having a connector or coupling 41 at one end, which is used to engage with a muffler tail pipe of an automobile vehicle for using the exhaust gas therefrom for fighting a fire. Hose 40 is provided with a sleeve 42 that is suitably secured thereto, and a handle 43 is fixedly secured to sleeve 42 for directing a cone or nozzle 44 at a fire. Cone 44 is also provided with cooling fins 45 on its exterior, and may be used as a carry article in a vehicle for use in putting out vehicle fires, etc.

In use the function of hose 40 and cone 44, are similar to the use of machine 10, with the exception, that device 39 is readily available in a vehicle for putting out a fire through the use of a vehicle engine's exhaust. All that is needed is that the user move his vehicle near the vehicle or anything else that is on fire, and when the engine is first turned off, the user couples the connector 41 to the exhaust and then restarts the engine and while grasping the handle, he points the cone 44 on the fire.

While various changes may be made in the detailed structure, such changes will be within the spirit and scope of the present invention, as defined by the appended claims.

What is claimed is:

1. A combination exhaust gas fire extinguisher and blower machine, comprising an internal combustion engine, a blower coupled to said engine, an engine housing receiving said engine, a blower housing receiving said blower and secured to said engine housing, a pivotal cover secured to said engine housing, for covering and uncovering the exhaust pipe area of said engine, a flexible control cable secured to said pivotal cover, for the operator to switch from blower operational function, to fire extinguishing function, a first flexible hose secured to said pivotal cover and to said blower, and a second flexible hose secured to an air cooled cone and said blower.

2. The combination as set forth in claim 1, wherein said exhaust pipe extends from an opening provided through a cover plate secured to said engine housing, and an open end of said pivotal cover is secured by a hinge to said cover plate and the rim of said open end of said pivotal cover engages with the outer surface of said cover plate and prevents the escape of said exhaust gas from said exhaust pipe, except through said first flexible hose which is suitably secured in an opening through said pivotal cover.

3. The combination as set forth in claim 2, wherein said pivotal cover is opened and closed by said flexible control cable which includes a knob on one end for being held by an operator, and the opposite end of said first flexible hose is secured within a central opening provided through a blower plate secured over an air inlet opening through said blower housing.

4. The combination as set forth in claim 3, wherein said exhaust gas is piped from within said pivotal cover into said first flexible hose and into the air inlet opening through said blower housing, and said blower blows said gas out of said second flexible hose which is suitably secured in an opening through one face of said blower housing.

5. The combination as set forth in claim 4, wherein said second flexible hose is also secured to a sleeve having a handle fixedly secured for holding said second flexible hose.

6. The combination as set forth in claim 5, wherein a hollow cone is secured to said sleeve by a set screw and cooling fins are provided on said cone at its smaller diameter portion for cooling of said exhaust gas as said gas leaves said cone onto a fire, and further cooling is provided by louvers pivotally received within openings through said blower plate and said louvers are of the spring-return type that enables the openings through said blower plate to normally remain covered and when said machine is operated, the speed of said engine governs the degree of opening of said louvers which enables inlet air entry into said blower for cooling of said exhaust gas.

* * * * *